US007329836B2

(12) United States Patent
Suzuki

(10) Patent No.: US 7,329,836 B2
(45) Date of Patent: Feb. 12, 2008

(54) GLOW PLUG WITH O-RING SEAL

(75) Inventor: Hiroyuki Suzuki, Kasugai (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 11/693,882

(22) Filed: Mar. 30, 2007

(65) Prior Publication Data

US 2007/0241092 A1 Oct. 18, 2007

(30) Foreign Application Priority Data

Mar. 30, 2006 (JP) ..... 2006-94548

(51) Int. Cl.
*F23Q 7/00* (2006.01)
*F23Q 7/22* (2006.01)

(52) U.S. Cl. ..... 219/260; 219/270

(58) Field of Classification Search ..... 219/260, 219/261, 262, 263, 264, 265, 266, 267, 268, 219/269, 270

See application file for complete search history.

(56) References Cited

U.S. PATENT DOCUMENTS 6,539,787 B1 * 4/2003 Murai et al. ..... 73/119 R
6,744,015 B2 * 6/2004 Tanaka et al. ..... 219/267
7,115,836 B2 * 10/2006 Yoshikawa et al. ..... 219/270
7,185,621 B2 * 3/2007 Yamada et al. ..... 123/145 A

FOREIGN PATENT DOCUMENTS

JP 2005 315474 11/2005

* cited by examiner

*Primary Examiner*—Daniel Robinson
(74) *Attorney, Agent, or Firm*—Stites & Harbison PLLC; Ross F. Hunt, Jr.

(57) ABSTRACT

An O-ring for a glow plug has a transverse cross section of an elliptical contour and is disposed between a tapered surface of an axial hole of a metallic shell and a sealing portion of a center shaft. The O-ring is pressed on from the rear by an end surface of a press member. Because the longer side surfaces of the O-ring, as viewed in cross section, contact the tapered surface and the outer circumferential surface of the sealing portion, the contact areas between the O-ring and the tapered surface and the outer circumferential surface of the seal portion are increased. In addition, because the amount of deformation is small, internal stress is controlled, and the degree of contact is increased, so that the axial hole is reliably maintained airtight.

15 Claims, 9 Drawing Sheets

TERMINAL ASSEMBLY STEP

GLOW PLUG WITH O-RING SEAL

BACKGROUND OF THE INVENTION

1. Field of the Invention

The present invention relates to glow plugs used in assisting startup of a diesel engine.

2. Description of the Related Art

Conventionally, glow plugs used in assisting startup of a diesel engine include a tubular metallic shell and a heater mounted at the front end of an axial hole of the shell, and are configured such that a front end portion of the heater projects into the engine. Further, a bar-shaped center shaft, formed of metal, is inserted into the axial hole of the metallic shell. The center shaft is insulated from the metallic shell and is mounted such that one end portion of the center shaft projects from the rear end of the metallic shell. Two electrodes extend from the heater so as to supply electricity to the heater and are electrically connected to the metallic shell and the center shaft, respectively.

In a glow plug having such a structure, in order to maintain the axial hole of the metallic shell airtight, an O-ring is disposed between the wall surface of the axial hole and the center shaft at the rear end of the axial hole. Further, an insulating member is disposed between the wall surface of the axial hole and the center shaft, and the O-ring is pressed from the rear end side by an end surface of the insulating member. Thus, the O-ring is brought into close contact with the end surface of the insulating member, the wall surface of the axial hole, and the outer circumferential surface of the center shaft, so as to seal the interior of the axial hole. Reference is made, for example, to Japanese Patent Application Laid-Open (kokai) No. 2005-315474.

One problem that has occurred with current glow plug constructions is that glow plugs have been reduced in diameter so as to meet the recent demand for downsizing diesel engines, and the clearance space between the wall surface of the axial hole and the center shaft of each glow plug has decreased. Therefore, disposing an O-ring in the clearance space at the time of assembly of a glow plug is difficult. In addition, because the cross section of an O-ring perpendicular to the circumferential direction thereof is of a circular shape, when such an O-ring is disposed in the narrow clearance space between the wall surface of the axial hole and the center shaft, a portion thereof undergoes substantial local deformation, because the O-ring is sandwiched between the wall surface of the axial hole and the outer circumferential surface of the center shaft and is pressed by the insulating member. If the internal stress of the O-ring increases due to that deformation, the elastic force of the O-ring decreases, which reduces the degree of contact between the wall surface of the axial hole and the outer circumferential surface of the center shaft, and makes it difficult to maintain the axial hole airtight.

SUMMARY OF THE INVENTION

According to one aspect thereof, the present invention solves the above problems, and thus an object of the invention is to provide a glow plug which is configured such that an O-ring can be readily disposed between the wall surface of an axial hole of a metallic shell and a center shaft during the course of manufacture of the glow plug, and the O-ring so disposed reliably maintains the axial hole airtight.

To achieve this and other objects, a glow plug is provided which comprises a tubular metallic shell including an axial hole extending through the metallic shell along an axis; a rod-shaped center shaft extending along the axis and disposed in the axial hole of the metallic shell with a clearance between the center shaft and a wall surface of the axial hole, one end portion of the center shaft projecting from a rear end surface of the metallic shell; an O-ring disposed at a rear end of the axial hole between the wall surface of the axial hole and the center shaft, the O-ring being in close contact with the wall surface of the axial hole and an outer circumferential surface of the center shaft; and an annular press member including an insertion hole into which the center shaft is inserted, the press member being at least partially disposed between the wall surface of the axial hole and the center shaft and including an end surface for pressing against the O-ring from the rear thereof; at least one of a portion of the wall surface of the axial hole with which the O-ring is close contact and a portion of the outer circumferential surface of the center shaft with which the O-ring is close contact comprises a tapered surface that increases the clearance between the wall surface of the axial hole and the center shaft toward the rear end side along the axis; and the O-ring being of an annular shape extending circumferentially around said axis and a radial direction of the O-ring being defined as extending radially from said axis, said O-ring being configured such that one of two transverse cross sections of the O-ring is of a contour such that a distance defined between two spaced tangential lines which are parallel to the radial direction of the O-ring and are tangent to the contour of the one cross section is greater than a distance between two spaced tangential lines which are perpendicular to the radial direction and are tangent to the contour of the one cross section prior to assembly of the O-ring.

In addition to having the above structure, the glow plug is preferably characterized in that wherein the O-ring satisfies a relation $1.2<=V/H<=2.0$ prior to assembly of the O-ring to the glow plug, wherein V represents a distance between two spaced tangential lines which are parallel to the radial direction of the O-ring and are tangent to the contour of the one cross section, and H represents a distance between two spaced tangential lines which are perpendicular to the radial direction and are tangent to the contour of the one cross section, in the one of two transverse cross sections of the O-ring.

Preferably, the glow plug is further characterized in that the center shaft includes a terminal connection portion which is provided at a rear end thereof and to which a connection terminal of an external circuit is connected directly or indirectly; and a relation $D1>d1$ is satisfied prior to assembly of the O-ring to the glow plug, wherein D1 represents the minimum inner diameter of the O-ring, and d1 represents the maximum diameter of the terminal connection portion of the center shaft.

Advantageously, in addition to having the structure of the preceding paragraph, the glow plug is characterized in that a relation $d1<d2$ is also satisfied, wherein d2 represents the diameter of the center shaft at a portion located forwardly of the terminal connection portion in the direction of said axis, and a relation $D1<d2$ is also satisfied.

Preferably, in addition to having the structure described in one or more of the above paragraphs, the glow plug is characterized in that the tapered surface is formed at a portion of the outer circumferential surface of the center shaft with which portion the O-ring comes into close contact; and a relation $d2<D1<d3$ is satisfied prior to assembly of the O-ring to the glow plug, wherein D1 represents the minimum inner diameter of the O-ring, d2 represents the diameter of the center shaft at a portion between the terminal connection portion and the tapered surface, and d3 represents the diameter of the center shaft at a portion located forwardly of the tapered surface in the direction of said axis.

Advantageously, in addition to having the structure described in one or more of the above paragraphs, the glow plug is characterized in that a relation D2<d4 is satisfied prior to assembly of the O-ring to the glow plug, wherein D2 represents the maximum outer diameter of the O-ring, and d4 represents a diameter of a ridge line formed between the rear end surface of the metallic shell and the wall surface of the axial hole.

Preferably, in addition to having the structure described in one or more of the preceding paragraphs, the glow plug is characterized in that a threaded mounting portion for mounting the shell in a threaded hole of an internal combustion engine by screwing the mounting portion into the threaded hole; and a tool engagement portion for engaging a tool used when the threaded mounting portion is screwed into the threaded hole; the metallic housing having a width across a corner of no more than 8.8 mm or less at the tool engagement portion, and the metallic shell having a nominal outer diameter of no more than 8 mm at the threaded mounting portion.

In the glow plug described above, the O-ring disposed between the wall surface of the axial hole of the metallic shell and the outer circumferential surface of the center shaft is configured such that its cross section perpendicular to the circumferential direction of the O-ring has a length in a direction perpendicular to the radial direction of the O-ring longer than that in the radial direction. In other words, a cross section of the O-ring taken in the radial direction is of an oval shape, an elliptical shape, or a like shape, whose longitudinal direction coincides with a direction perpendicular to the circumferential direction, i.e., the axial direction. These shapes include an incomplete oval or elliptical shape such as, for example, an elliptical shape in which one of semicircles of the ellipse differs in radius from the other. By virtue of such a shape, when the O-ring is pressed from the rear end thereof by means of the press member, and the O-ring receives a reaction force in the pressing direction from the tapered (taper) surface formed on at least one of the wall surface of the axial hole and the outer circumferential surface of the center shaft and elastically deforms, the O-ring comes into contact with the two surfaces over a larger area or region as compared with a conventional O-ring having a circular cross section. Therefore, a glow plug assembled with the O-ring can more reliably maintain the axial hole airtight.

Preferably, at least one of a portion of the wall surface of the axial hole with which a portion the O-ring comes into close contact, and a portion of the outer circumferential surface of the center shaft with which a portion the O-ring comes into close contact is tapered, i.e., formed as a tapered or taper surface. Therefore, the O-ring will be fully engaged with the tapered surface and will generate a drag or resisting force against the tapered surface. Even in the case where one of the two surfaces is not a tapered surface, the other or remaining surface is a tapered surface. Therefore, through adjustment of the direction in which the press member presses the O-ring, an urging or pressing force is generated so that drag can be generated between the non-tapered surface and the O-ring, so that the degree of contact between the non-tapered surface and the O-ring can be sufficiently increased to ensure that airtight sealing is produced.

As described above, the O-ring has a cross section which is elongated in the direction perpendicular to the direction of the clearance between the wall surface of the axial hole of the metallic shell and the outer circumferential surface of the center shaft. When such an O-ring is disposed between the wall surface of the axial hole of the metallic shell and the outer circumferential surface of the center shaft, the amount of deformation of the O-ring required in providing a large area of contact with the two surfaces is small, and thus any increase in the internal stress on the O-ring is small. Therefore, the O-ring can readily and easily deform to fit the surface shapes of the two surfaces, and thus, size of the contact areas can be further increased. Accordingly, the degree of contact between the O-ring and the wall surface of the axial hole and between the O-ring and the outer circumferential surface of the center shaft can be increased further, whereby the airtightness of the axial hole can be maintained even more reliably. Moreover, since local concentration of the internal stress on the O-ring can be avoided, deterioration of the material of the O-ring or breakage of the O-ring, which would otherwise occur because of expansion and contraction of the O-ring with changes in the ambient temperature, vibration, or other causes, is prevented or combated. Thus, a contact state sufficient for maintaining the airtightness of the axial hole can be secured.

It will be appreciated that the O-ring preferably has the above-described shape before the O-ring is assembled to the glow plug. Moreover, the shape of the O-ring before the O-ring is assembled to the glow plug can be confirmed by disassembling the O-ring from the glow plug.

As indicated above, the O-ring preferably satisfies the relationship between the axial length (V) and the radial length (H) of $1.2<=V/H$, before the O-ring is assembled to the glow plug. Such an O-ring can provide a closer connection within a axial hole and thus provide better sealing, in comparison with a conventional O-ring which has a circular shape in cross section. Further, as was also indicated above, an O-ring satisfying the relationship $V/H<=2.0$ before the O-ring is assembled to the glow plug can reduce contact friction generated when the O-ring is inserted between an internal wall surface of the axial hole and an outer surface of the center shaft, and thus can facilitate O-ring assembly. Further, distortion of the O-ring caused by a difference between the axial length and the radial length in the cross section can be decreased and a structure that enables proper urging of the O-ring into position can be realized.

The O-ring is typically assembled into a glow plug through an operation including fitting the O-ring onto one end of the center shaft disposed in the axial hole of the metallic shell and moving the O-ring to a final or disposition position between the wall surface of the axial hole and the outer circumferential surface of the center shaft. A rear end portion of the center shaft is used as a terminal connection portion to which a connection terminal for connection with an external circuit is connected. In some cases, an intermediate member (which corresponds to a terminal metal member or piece in this embodiment) for connection with the connection terminal is fixed to the terminal connection portion.

In some embodiments, surface machining, such as knurling, is performed on the outer circumferential surface of the terminal connection portion so as to fix the intermediate member more reliably. Further, in the case where the connection terminal is directly connected without use of the intermediate member, in some embodiments a male thread is provided for connection with the connection terminal. In such a case, the outer circumferential surface of the terminal connection portion is non-uniform, and the inner circumferential surface of the O-ring rubs the machined portion and is damaged when the O-ring is moved. This may impact the performance of the O-ring. In order to solve this problem, the minimum inner diameter D1 of the O-ring is preferably made greater than the maximum diameter d1 of the terminal connection portion as described above. Examples of external circuits include an external power source circuit including a battery and associated components, and a signal-processing circuit, which is employed when the glow plug includes a pressure sensor, and which is used for outputting a signal from the pressure sensor.

When the diameter d2 of the center shaft at a portion located forwardly or frontwardly of the terminal connection portion in the axial direction is made greater than the minimum inner diameter D1 of the O-ring, as described above, the O-ring having the minimum inner diameter D1 is expanded by the portion of the center axis having the diameter d2. Therefore, the O-ring produces a drag or frictional force in the radial direction against the outer circumferential surface of the center shaft, and achieves a high degree of contact. This structure is more effective in the case where a portion of the outer circumferential surface of the center shaft with which portion the O-ring comes into close contact is not tapered. In this case, through adjustment of the direction in which the press member presses the O-ring, a drag can be generated between the O-ring and the outer circumferential surface of the center shaft. In this way, the degree of contact, i.e., the closeness of the contact of the O-ring against the outer circumferential surface of the center shaft, can be increased.

In the case where a portion of the outer circumferential surface of the center shaft with which portion the O-ring comes into close contact is tapered, the direction of the drag generated between the O-ring and the tapered surface does not coincide with the radial direction of the O-ring. When the diameter d2 of the center shaft at a portion between the terminal connection portion and the tapered surface is made smaller than the minimum inner diameter D1 of the O-ring, as described above, the above-described drag exerted on the outer circumferential surface of the center shaft due to deformation of the O-ring is not generated. However, since drag can be generated between the O-ring and the tapered surface when the O-ring is pressed by means of the press member, the airtightness of the axial hole can be sufficiently maintained.

Considering the latter point in more detail, since the minimum inner diameter D1 of the O-ring is greater than the diameter d2 of the center shaft and the maximum diameter d1 of the terminal connection portion, the O-ring fitted onto the center shaft from one end portion thereof can be easily moved until the O-ring comes into contact with the tapered surface. At this time, when the diameter d3 of the center shaft at a portion located forwardly or frontwardly of the tapered surface is greater than the minimum inner diameter D1 of the O-ring, the O-ring can be reliably brought into contact and engagement with the tapered surface of the center shaft. Therefore, when pressure is exerted on the O-ring by means of the press member, the O-ring can produce the desired drag against the tapered surface.

As described above, the O-ring is fitted onto the center shaft from one end portion thereof projecting from the rear end surface of the metallic shell, is axially moved, and is accommodated within the axial hole of the metallic shell. When the maximum outer diameter D2 of the O-ring is made smaller than the diameter d4 of the ridge line formed between the rear end surface of the metallic shell and the wall surface of the axial hole as described above, the O-ring does not interfere with the rear end surface. Accordingly, the O-ring can be readily guided into the axial hole and moved to a final or disposition position between the wall surface of the axial hole and the outer circumferential surface of the center shaft.

An O-ring according to the present invention is particularly applicable to what is referred to as a small diameter glow plug, in which the metallic housing has a width across corner of 8.8 mm or less at the tool engagement portion, and the metallic housing has a nominal outer diameter of 8 mm or less at the mounting threaded portion.

Further features and advantages of the present invention will be set forth in, or apparent from, the detailed description of preferred embodiments thereof which follows.

DETAILED DESCRIPTION OF THE PREFERRED EMBODIMENTS

One implementation of a glow plug which embodies important aspects of the present invention will next be described with reference to the drawings. However, it will be understood that the present invention should not be construed as being limited to this implementation.

Figure 1:
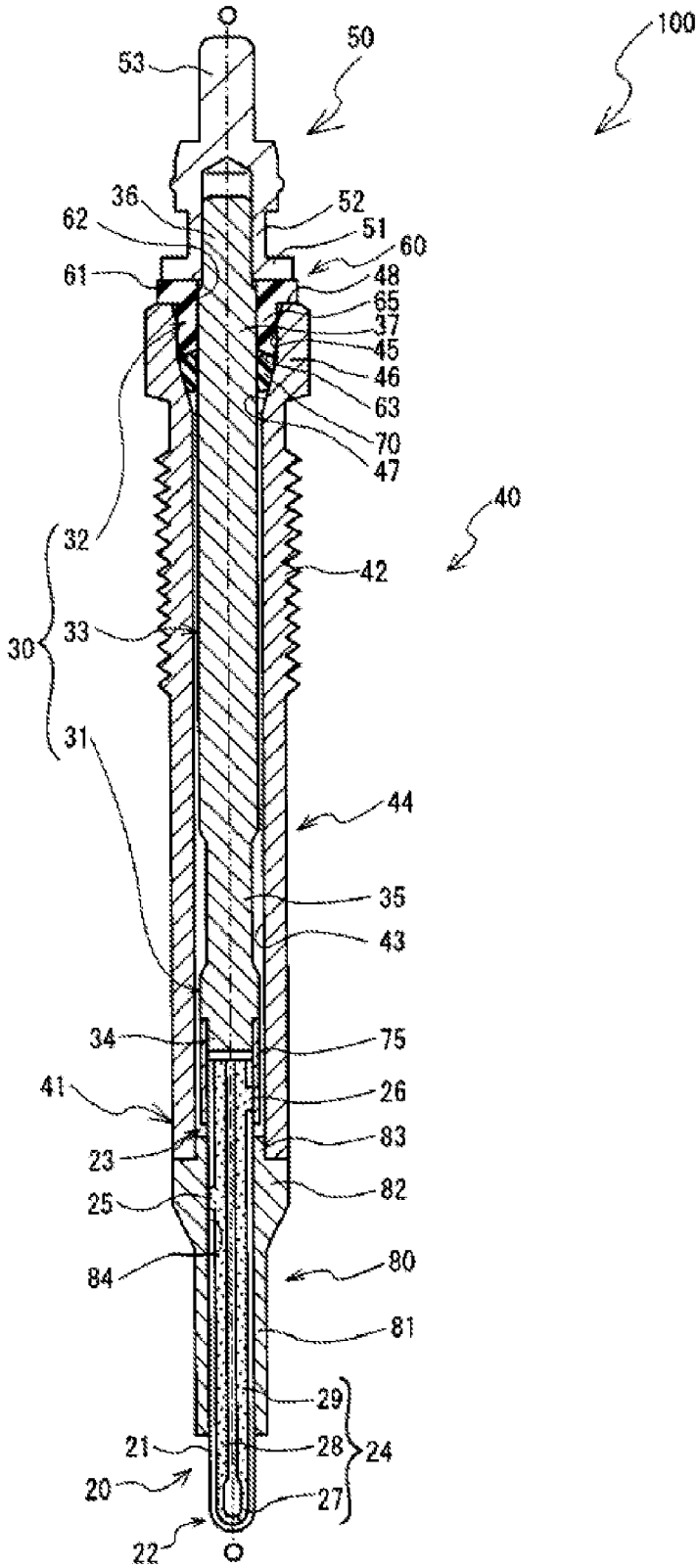
FIG. 1 is a vertical cross sectional view of a glow plug in accordance with a preferred embodiment of the invention.
Figure 2:
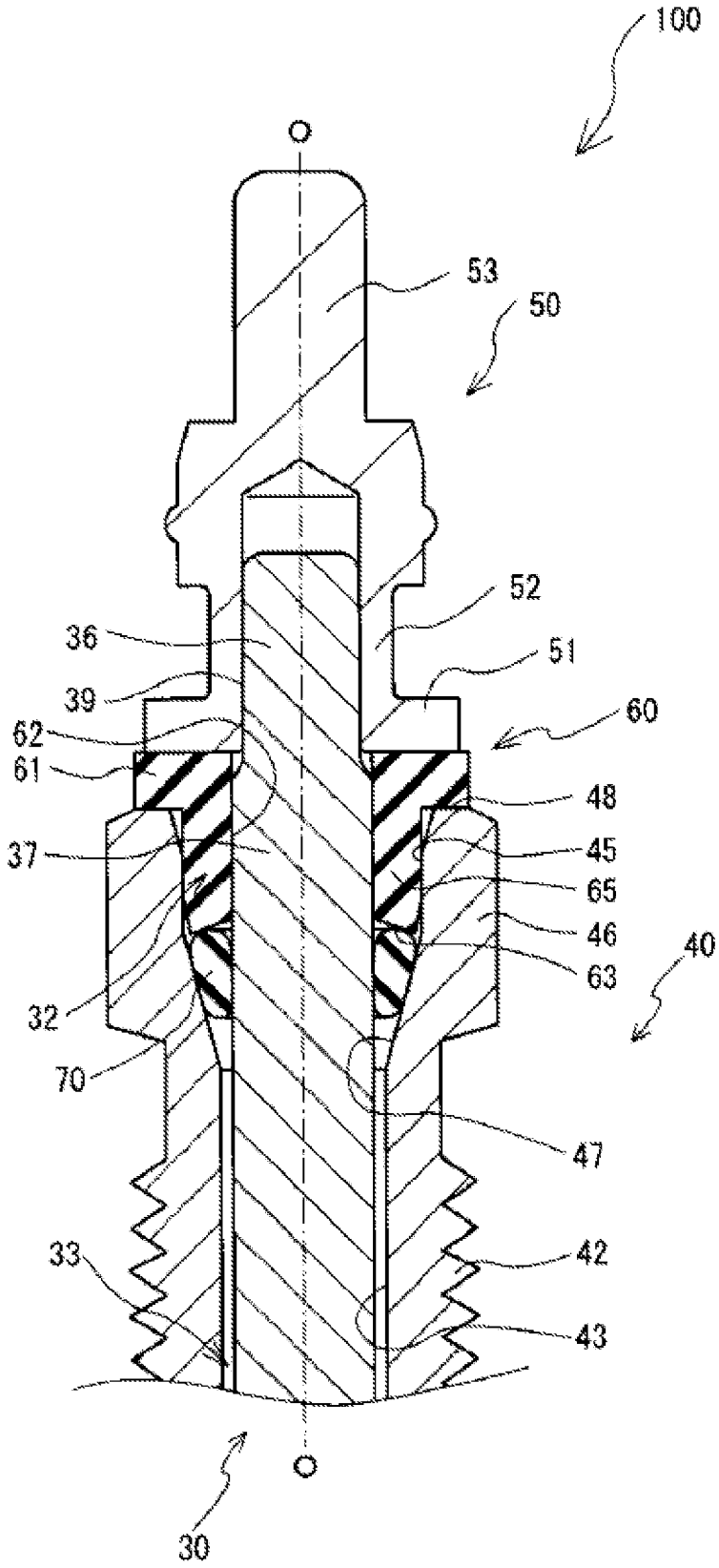
FIG. 2 is a perspective view of a center shaft of the embodiment of FIG. 1.
Figure 3:
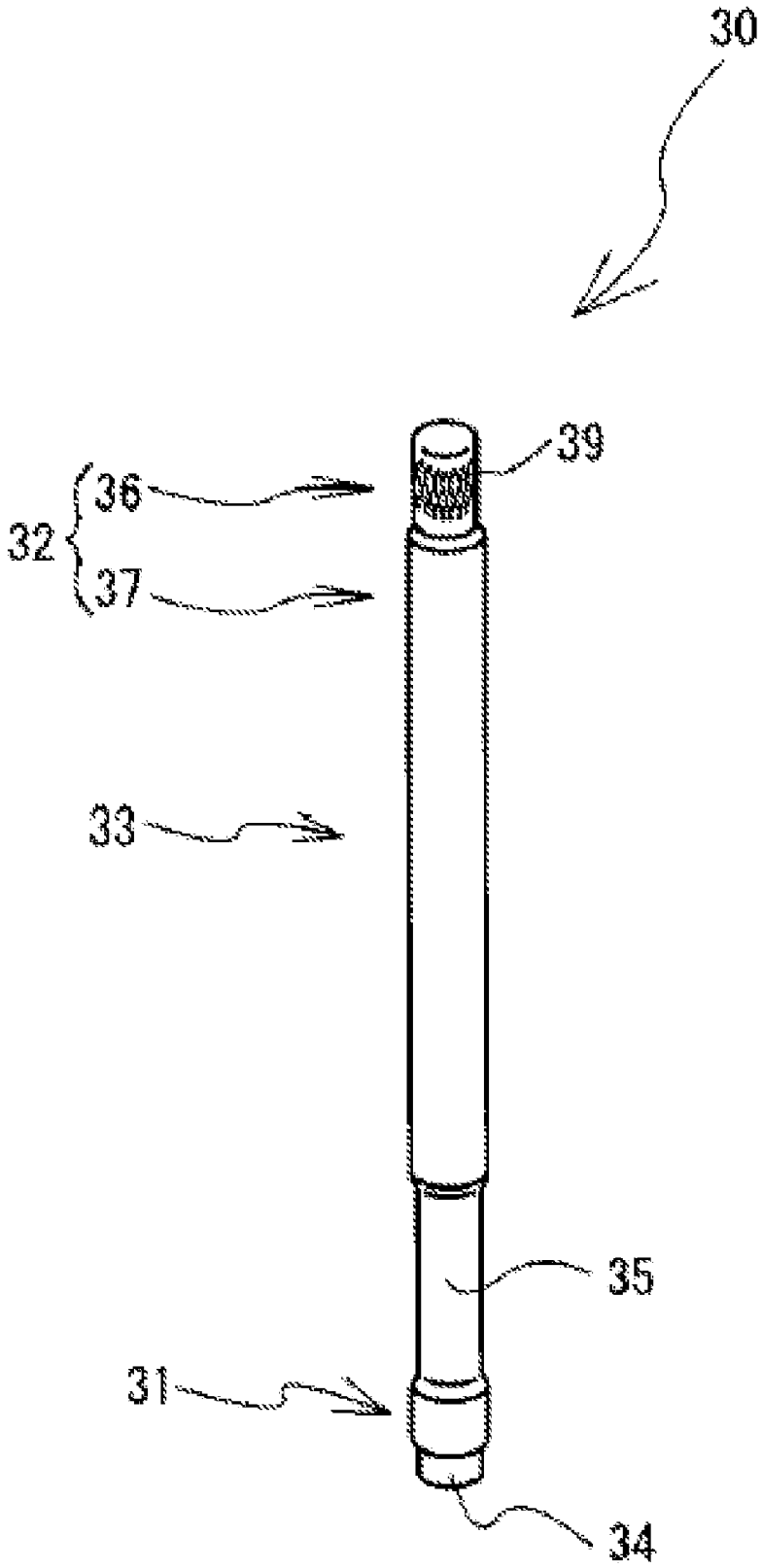
FIG. 3 is an enlarged cross sectional view of a rear end portion, and the area in the vicinity thereof, of the glow plug of FIG. 1.

First, the overall structure of an exemplary glow plug 100 will be described in reference to FIGS. 1 to 3. FIG. 1 is a vertical sectional view of the glow plug 100. FIG. 2 is an enlarged sectional view of a rear end portion, and its vicinity, of the glow plug 100. FIG. 3 is a perspective view of a center shaft 30. In the following description, the end of the glow plug 100 in which a ceramic heater 20 is disposed (which is the lower end as viewed in FIG. 1) with respect to the direction of a longitudinal axis O will be referred to as the front end of the glow plug 100.

The glow plug 100 shown in FIG. 1 is adapted to be attached to a combustion chamber (not shown) of, for example, a direct-injection-type diesel engine, and is used as a heat source for assisting ignition at the time of starting the engine. The glow plug 100 is principally composed or comprised of the following components: the center shaft 30; the ceramic heater 20, which includes a heat generation body 27; a tubular member 80 radially holding the ceramic heater 20; and a metallic shell 40 having an axial hole 43 therein through which the center shaft 30 is inserted, and a front end portion 41 joined to the tubular member 80.

Considering the ceramic heater 20 in more detail, the ceramic heater 20 is configured in such a manner that a heat generation element 24, formed of a conductive ceramic and having a generally U-shaped cross section, is embedded in a substrate 21 of a round bar shape, formed of an insulating ceramic and having a front end portion 22 of a semispherical or rounded shape. The heat generation element 24 is composed or comprised of the heat generation body 27 disposed in the front end portion 22 of the ceramic heater 20. Body 27 has opposite end portions folded back into, or assuming a generally U-like shape along, the curved surface of the front end portion 22, and lead portions 28 and 29 connected to the opposite ends of the heat generation body 27 and generally extending in parallel along the axis O toward a rear end portion 23 of the ceramic heater 20. The heat generation body 27 is of a smaller cross-sectional area than the lead portions 28 and 29. Therefore, when electricity is supplied to the heat generation element 24, heat is mainly generated at the heat generation body 27. Further, on an outer circumferential surface of the ceramic heater 20 located on the rear end side in relation to the center thereof, electrode output portions or output electrodes 25 and 26, which project from the lead portions 28 and 29, respectively, are exposed at different positions with respect to the direction of the axis O.

Next, the tubular member 80 will be described. The tubular member 80 is a cylindrical, tubular metallic member extending along the direction of the axis O. The tubular member 80 radially holds or retains a body portion of the ceramic heater 20 within a cylindrical hole 84 therein such that the front end portion 22 and the rear end portion 23 are exposed from the opposite ends of the cylindrical hole 84.

The tubular member 80 has a thick flange portion 82 at the rear end of a body portion 81 thereof. The tubular member 80 also has a stepped shell engagement portion 83 formed at the rear end thereof. The shell engagement portion 83 engages the inner circumference of the front end portion 41 of the metallic shell 40, which will be described in more detail later, so as to be joined to the metallic shell 40.

Turning to the electrode output portions 25 and 26 of the ceramic heater 20, the electrode output portion 25 formed frontwardly in relation to the electrode output portion 26 is in contact with the wall surface of the cylindrical hole 84 of the tubular member 80, whereby the electrode output portion 25 is electrically connected to the tubular member 80.

A connection ring 75 formed of a metal and of a tubular shape is fitted to the rear end portion 23 of the ceramic heater 20 projecting rearwardly from the shell engagement portion 83 of the tubular member 80. The electrode output portion 26 of the ceramic heater 20 is in contact with the inner circumferential surface of the connection ring 75, whereby the electrode output portion 26 is electrically connected to the connection ring 75. The front end portion 41 of the metallic shell 40 is joined to the shell engagement portion 83 of the tubular member 80, whereby the metallic shell 40 and the tubular member 80 are electrically connected together. Although the rear end portion 23 of the ceramic heater 20 and the connection ring 75 are disposed within the metallic shell 40, the ceramic heater 20 and the metallic shell 40 are respectively positioned with respect to the tubular member 80 such that, and the metallic shell 40 and the connection ring 75 are maintained in a non-contact state such that, the latter two members are electrically insulated from each other.

Turning to the metallic shell 40, metallic shell 40 is an elongated tubular metallic member having the above-mentioned axial hole 43, which penetrates the shell in the direction of, i.e., along, the axis O. A male thread portion 42 for attaching the glow plug 100 to an engine head (not shown) of an internal combustion engine (not shown) is formed at the rear end side of an intermediate body portion 44 of the metallic shell 40.

As shown in FIG. 2, a tool engagement portion 46, with which, in use, a tool used for attaching the glow plug to the engine head is engaged, is formed at the rear end of the intermediate body portion 44 (see FIG. 1). In the present embodiment, the tool engagement portion 46 has a hexagonal cross section, and the axial hole 43 is of increased diameter within the tool engagement portion 46. This portion is referred to herein as an increased-diameter portion 45. Adjacent the increased-diameter portion 45, the axial hole 43 includes a tapered surface 47 the diameter of which gradually increases toward the rear end of the axial hole. The axial hole 43 opens at a rear end surface 48 of the metallic shell 40 at the increased-diameter portion 45, and the opening portion is chamfered. As shown in FIG. 1, the inner circumference of the front end portion 41 of the metallic shell 40 is engaged with the outer circumference of the shell engagement portion 83 of the tubular member 80, and the joint or joining portion between these members is laser-welded from the outside, so that the metallic shell 40 and the tubular member 80 are integrally joined together.

Considering the center shaft 30, as shown in FIGS. 1 and 3, the center shaft 30 comprises a metal rod extending along the direction of the axis O, and is inserted into the axial hole 43 of the metallic shell 40. A small-diameter portion 35 of a reduced diameter is formed at the front end side of an intermediate body portion 33 of the center shaft 30. A small-diameter ring engagement portion 34 for engagement with the inner circumference of the connection ring 75 is formed at the distal end of a front end portion 31 located on the front end side in relation to the small-diameter portion 35.

Through engagement of the ring engagement portion 34 with the connection ring 75, the ceramic heater 20 and the center shaft 30 are integrally connected along the axis O via the connection ring 75. It is noted that the front end portion 31 of the center shaft 30 and the connection ring 75 are integrally joined by means of laser welding performed externally at the joint portion between these members. Thus, the center shaft 30 is electrically connected to the electrode output portion 26 of the ceramic heater 20 via the connection ring 75. Since the ceramic heater 20 and the metallic shell 40 are respectively positioned with respect to the tubular member 80 as described above, the center shaft 30 is maintained in a non-contact state or spaced relation within the axial hole of the metallic shell 40, and is electrically insulated from shell 40.

As shown in FIGS. 2 and 3, the center shaft 30 has a rear end portion 32, which includes a small-diameter, terminal connection portion 36 projecting from the rear end surface 48 of the metallic shell 40, and a seal portion 37 which comes into contact with an O-ring 70 (to be described later). The latter maintains airtight, i.e., seals, the axial hole 43 of the metallic shell 40. In the present embodiment, the seal portion 37 has the same diameter as the intermediate body portion 33 and is continuous with the intermediate body portion 33. As shown in FIG. 3, the outer circumferential surface of the terminal connection portion 36 is surface-machined and, in particular, knurled so as to form an engagement portion 39.

The O-ring 70 and an insulating press member 60 are provided at the rear end portion 32 of the center shaft 30.

The press member 60 is of a cylindrical tubular shape and includes an insertion hole 62. The O-ring 70 is of an annular shape and made from an insulating elastic material such as fluoro rubber, acrylic rubber, or silicone rubber. A body portion 65 of the press member 60 is disposed between the wall surface of the increased-diameter portion 45 of the axial hole 43 and the seal portion 37 of the center shaft 30 so that the center shaft 30 inserted into the insertion hole 62 of the press member 60 is positioned within the increased-diameter portion 45, and insulation is provided between the center shaft 30 and the metallic shell 40.

As shown, e.g., in FIG. 2, the O-ring 70, which is disposed between the outer circumferential surface of the seal portion 37 and the tapered surface 47 of the axial hole 43, is pressed toward the front end of the glow plug assembly 100 by means of a front end surface 63 of the press member 60, so that the O-ring 70 is in close contact with, i.e., fully engages, the tapered surface 47 of the axial hole 43 and the outer circumferential surface of the seal portion 37 of the center shaft 30. The end surface 63 of the press member 60 is tapered such that the apex of an imaginary conical surface passing through the end surface 63 is located on the longitudinal axis O. This construction reduces the difference between the drag between the pressed and deformed O-ring 70 and the seal portion 37 and the drag between the O-ring 70 and the tapered surface 47 of the axial hole 43, to thereby reduce any imbalance in the degree of engagement of the O-ring 70.

A flange portion 61 is provided at the rear end of the press member 60. This flange portion 61 engages the rear end surface 48 of the metallic shell 40 and is disposed between the metallic shell 40 and a metal terminal member 50 described in more detail below connected to the terminal connection portion 36, to thereby insulate the metal terminal member 50 from the metallic shell 40.

The metal terminal member 50 is fitted to the terminal connection portion 36 projecting from the rear end surface 48 of the metallic shell 40. The metal terminal member 50 includes a cap-shaped body portion 52 which is fitted onto and surrounds the terminal connection portion 36, a pin-shaped projection portion 53 projecting rearwardly from the body portion 52, and a flange portion 51 radially projecting from the front end of the body portion 52.

The flange portion 51 of the terminal metal piece 50, which is fitted onto the terminal connection portion 36, is brought into contact with the flange portion 61 of the press member 60 so as to press the press member 60 frontwardly or forwardly in the axial direction, and the outer circumference of the body portion 52 is crimped, so that the inner circumferential surface of the body portion 52 is fully or strongly engaged with the engagement portion 39 of the terminal connection portion 36. In this manner, the metal terminal member 50 and the center shaft 30 are integrally joined together mechanically and are electrically connected together.

Because the engagement portion 39 is knurled, the fixing force which used to fix or secure the crimped metal terminal member 50 to the engagement portion 39 can be increased. When the glow plug 100 is attached to the engine head (not shown), an unillustrated plug cap is fitted onto the projection portion 53, and electrical power is supplied to the glow plug 100 from an external circuit.

In the glow plug 100 having the above-described structure, in order to increase the sealing or airtightness of the axial hole 43, the respective contact areas between the O-ring 70 and the outer circumferential surface of the seal portion 37 of the center shaft 30 and between the O-ring 70 and the tapered surface 47 of the axial hole 43 must be increased without impairing the stress (surface pressure) exerted on the respective contact surfaces. As described above, as the diameter of the glow plug 100 decreases, the clearance between the two above-mentioned surfaces decreases. It is theoretically possible to increase the contact areas between the O-ring 70 and the two surfaces by greatly deforming the O-ring 70 to match the clearance. However, in the smaller glow plugs which are currently in demand, since the O-ring 70 has a greatly reduced cross sectional area because of downsizing of the glow plug 100, the shape of the O-ring 70 changes greatly in response to a slight difference in the degree of pressure exerted by the press member 60, and thus, it is difficult to produce glow plugs 100 which have O-rings that are all of the same shape. If the pressure exerted is small, the sealing provided is not sufficiently airtight. If the pressure is excessive, the O-ring 70 is likely to harden and deteriorate, and thus the elastic force exerted thereby cannot be maintained at a sufficiently high level. As a result, it is difficult to maintain an airtight seal over a long period.

In order to solve the above-mentioned difficulty, in the present embodiment, in order to reduce the increase in internal stress on the O-ring 70 due to deformation, the shape of the cross section of the O-ring 70 perpendicular to the circumference, i.e., the shape of the transverse cross section, is such that the contact areas of the O-ring 70 with the two above-mentioned surfaces are increased, while the O-ring 70 is prevented from greatly deforming, so that the airtight sealing of the axial hole 43 is more reliably maintained. Further, in order to facilitate the task of disposing the O-ring 70 between the outer circumferential surface of the seal portion 37 of the center shaft 30 and the tapered surface 47 of the axial hole 43 during the course of manufacture of the glow plug 100, a defined relation between the size of the O-ring 70 and the diameters of the axial hole 43 and the center shaft 30.

Figure 4:
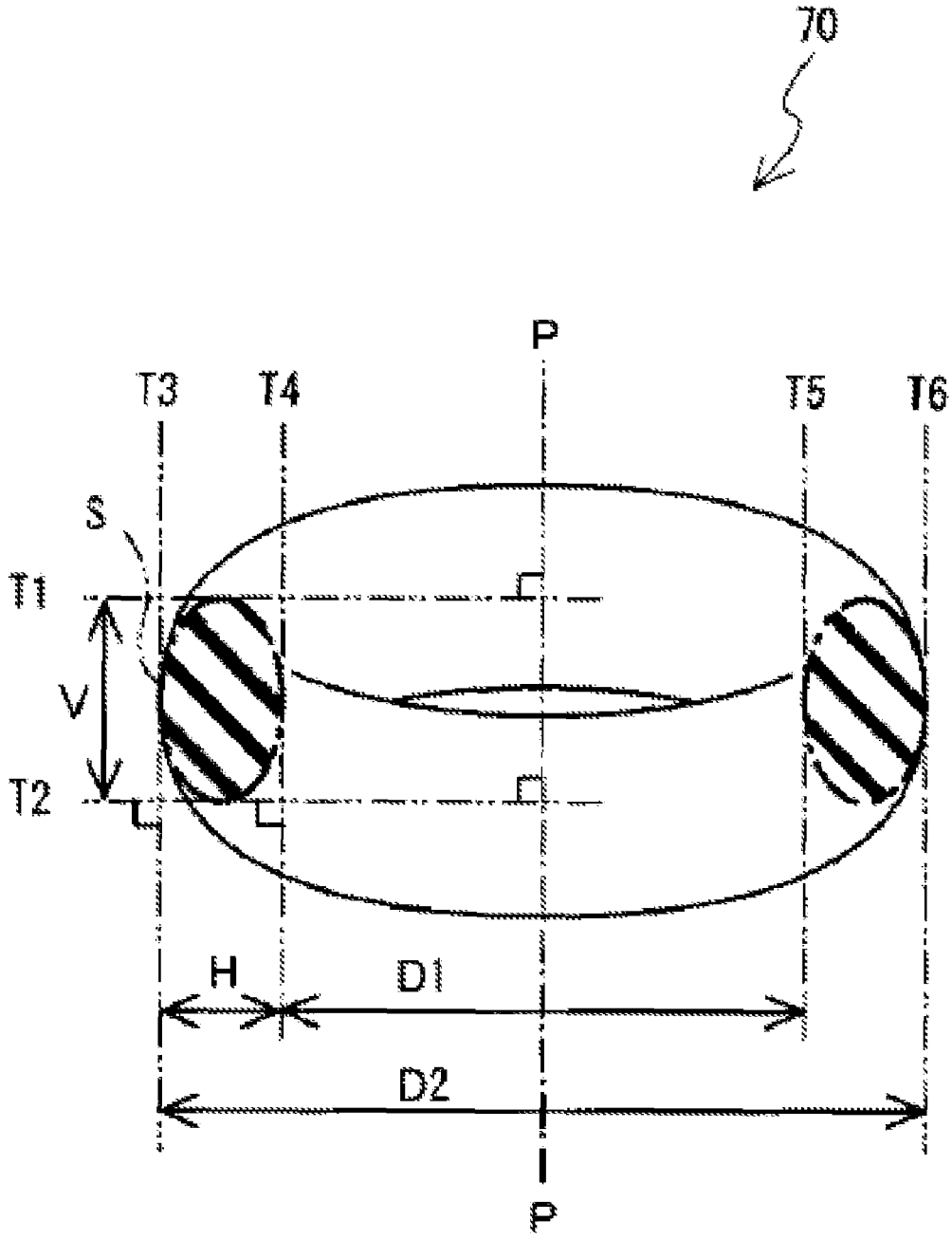
FIG. 4 is a perspective view of the O-ring of FIG. 1.

Hereinafter, the details of the O-ring 70 will be described with reference to FIGS. 4 and 5. FIG. 4 is a perspective view of the O-ring 70, and FIG. 5 is a sectional view showing the state of the O-ring 70 before the O-ring 70 is disposed between the center shaft 30 and the metallic shell 40.

As shown in FIG. 4, the O-ring 70 of the present embodiment is of an annular shape and extends circumferentially about a central axis P. The axis P coincides with the axis O when the O-ring 70 is incorporated into the glow plug 100. A cross section of the O-ring 70 perpendicular to the circumferential direction thereof (i.e., a transversed cross section produced as a result of the O-ring 70 being cut by an imaginary plane including the axis P) has an elliptical contour indicated at S that is elongated in the direction of the axis P. Specifically, the contour S of the cross section is such that, in an imaginary plane containing the cross section (for example, the plane of the sheet of FIG. 4), the axial (vertical) distance V between tangential lines T1 and T2 which are parallel to the radial direction of the O-ring 70 (i.e., a direction perpendicular to the axis P) and are tangent to the contour line S is greater than the radial (horizontal) distance H between tangential lines T3 and T4 which are perpendicular to the radial direction of the O-ring 70 and are tangent to the contour line S. More particularly, the relation between, i.e., the ratio (V/H) between, the axial distance V and the radial distance H satisfies the relationship: $1.2 <= V/H <= 2.0$.

It has been found that when V/H is 1.2 or larger, a large contact area can be obtained between the external peripheral surface of the O-ring 70 and the inner wall surface of the axial hole 43 and the outer surface of the center shaft 30. It has also bee found that when V/H is no greater than 2.0, contact friction between the O-ring 70, and the internal wall surface of the axial hole 43 and the outer surface of the center shaft 30 is prevented and the O-ring assembly process is facilitated. Furthermore, when V/H is greater than 2.0, any distortion of the O-ring 70 caused by the difference between the axial distance and the radial distance when the O-ring is pressed by the press member 60, is eliminated. It is noted that because the O-ring 70 is of an annular shape having a center located on the axis P, when the O-ring 70 is cut by the above-mentioned imaginary plane, two symmetrical cross sections are formed on the respective sides of the axis P. Because the two cross sections are symmetrical, only the shape of one of those cross sections will be described.

Figure 5:
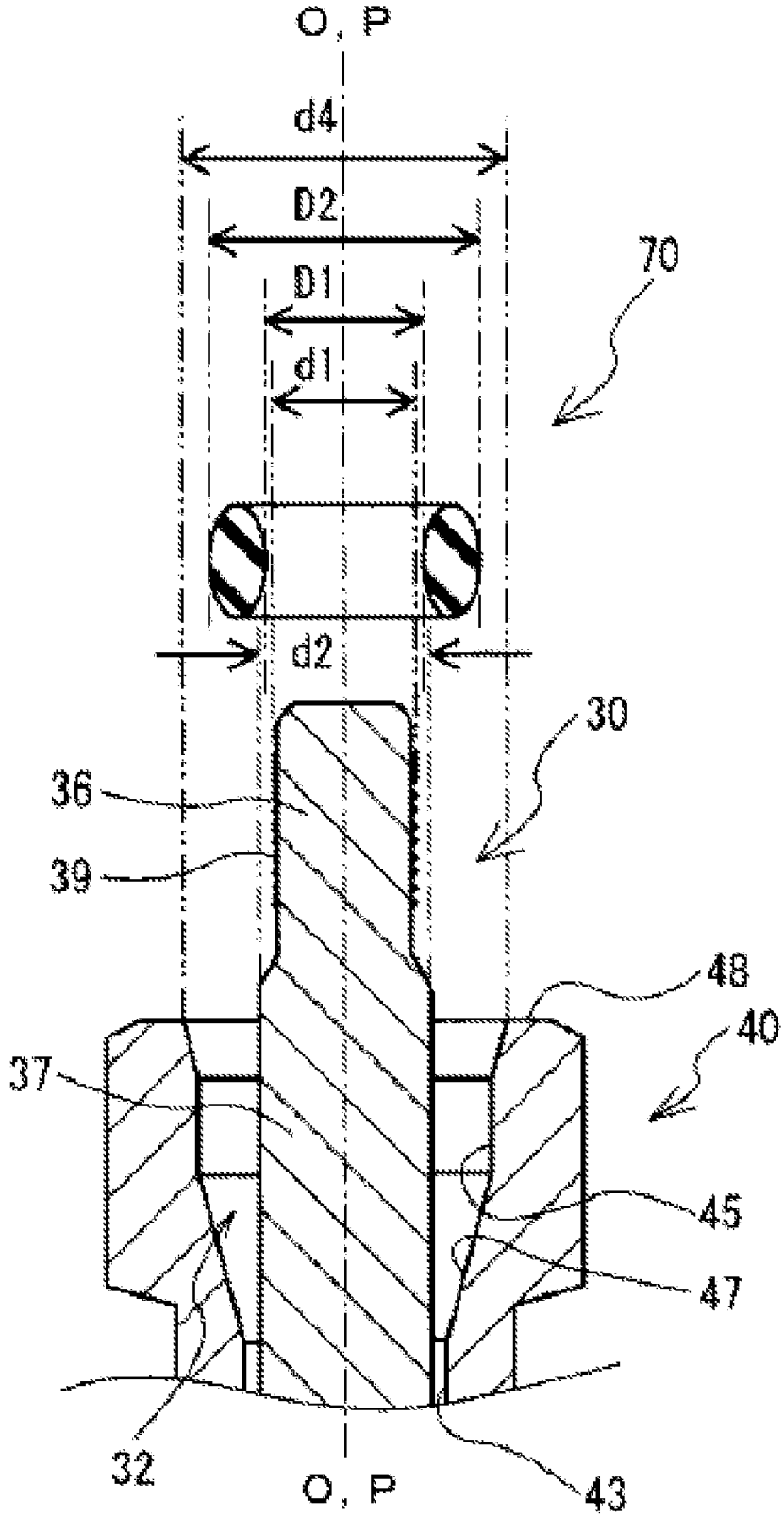
FIG. 5 is a cross sectional view showing a condition before the O-ring of FIG. 1 is disposed between the center shaft and a metallic shell.

As can be seen, for example, in FIG. 5, the wall surface of the axial hole 43 and the outer circumferential surface of the center shaft 30 face each other in a direction perpendicular to the axis O. Therefore, the O-ring 70 having a cross sectional shape elongated in the direction of the axis O at the time of assembly is disposed between the tapered surface 47 and the outer circumferential surface of the seal portion 37, the tapered surface 47 and the outer circumferential surface of the O-ring 70 come into mutual contact over a larger area than is the case where a conventional O-ring having a circular cross section is used. Similarly, the sealing portion 37 and the inner circumferential surface of the O-ring 70 come into mutual contact over a larger area than that is the case where a conventional O-ring having a circular cross section is used.

In the assembled state, the O-ring 70 is pressed by the end surface 63 of the press member 60, so that frictional forces are exerted on the above-mentioned two surfaces. The degree of contact between the O-ring 70 and the tapered surface 47 and between the O-ring 70 and the outer circumferential surface of the seal portion 37 is increased in the direction of the axis O, and the contact areas are increased, while the surface pressures are also increased. Further, since the shape of the contour S of the cross section of the O-ring 70 is initially elliptical, the amount of deformation at the time of the disposition of the O-ring 70 between the above-mentioned two surfaces is small, and the corresponding increase in the internal stress is also small, thereby preventing deterioration or breakage of the O-ring 70. Accordingly, degree of contact is increased between the O-ring 70 and the tapered surface 47 of the axial hole 43 and between the O-ring 70 and the outer circumferential surface of the seal portion 37 of the center shaft 30, and the axial hole 43 is more reliably maintained airtight.

Next, there will be described the relation in size among the metallic shell 40, the center shaft 30, and the O-ring 70 prior to the O-ring 70 being disposed between the tapered surface 47 of the axial hole 43 and the outer circumferential surface of the seal portion 37 of the center shaft 30 (i.e., the condition prior to assembly of the glow plug 100).

First, as shown in FIG. 5, the minimum inner diameter D1 of the O-ring 70 is greater than the maximum outer diameter d1 of the center shaft 30 at the terminal connection portion 36. As shown in FIG. 4, tangential lines T3, T4, T5, and T6, are parallel to the axis P (and thus perpendicular to the radial direction) and are tangent to two transverse cross sections of the O-ring 70 obtained by cutting the O-ring 70 with an imaginary plane passing through the axis P. The minimum inner diameter D1 of the O-ring 70 refers to the distance between the tangential lines T4 and T5, which are closer to the axis P than the remaining tangential lines.

Further, as described above, the engagement portion 39 of the terminal connection portion 36 of the center shaft 30 is subjected to surface machining such as knurling. Depending on the surface machining used (before machining), portions of the engagement portion 39 that project from the surface may be produced (before machining). Therefore, in the present embodiment, the maximum outer diameter d1 refers to the outer diameter of a portion having the larger outer diameter among the portions of the terminal connection portion 36, including the projecting portions produced as a result of the surface machining. Since the minimum inner diameter D1 of the O-ring 70 is greater than the maximum outer diameter d1 of the terminal connection portion 36, when the O-ring 70 is fitted onto the center shaft 30 from the rear end portion 32 (one end portion in the present embodiment), the O-ring 70 easily passes over the terminal connection portion 36.

In a case wherein the minimum inner diameter D1 of the O-ring 70 is no greater than the maximum outer diameter d1 of the terminal connection portion 36, when the O-ring 70 passes over the terminal connection portion 36, the inner circumference of the O-ring 70 engages and rubs against the knurled engagement portion 39 and may be damaged. If the surface of the O-ring 70 is damaged, the degree of contact with the seal portion 37 decreases, and the sealing of the axial hole 43, are decreased and are likely to be insufficient.

As shown in FIG. 5, the minimum inner diameter D1 of the O-ring 70 is smaller than the outer diameter d2 of the seal portion 37 of the center shaft 30. As described above, at the rear end portion 32 of the center shaft 30, the seal portion 37 faces the increased-diameter portion 45 and the tapered surface 47 of the axial hole 43 of the metallic shell 40. Thus, the seal portion 37 is located where the O-ring 70 is to be located after assembly of the glow plug 100. In the case of the center shaft 30 of the present embodiment, because the seal portion 37 has a cylindrical circumferential surface extending along the direction of the axis O, drag or frictional forces are generated between the O-ring 70 and the seal portion 37 in a direction perpendicular to the axis O. As described above, the drag on the O-ring 70 exerted by the end surface 63 of the press member 60 includes a component perpendicular to the axis O. Therefore, the O-ring 70 generates drag on the outer circumferential surface of the seal portion 37 to thereby achieve close contact therewith. When the minimum inner diameter D1 of the O-ring 70 is smaller than the outer diameter d2 of the seal portion 37, in addition to the above-mentioned drag, drag produced by deformation of the O-ring 70 itself is generated between the O-ring 70 and the seal portion 37. Therefore, the degree of contact of the O-ring 70 with the seal portion 37 is increased.

Moreover, as shown in FIG. 5, the maximum outer diameter D2 of the O-ring 70 is smaller than the diameter d4 of the ridge line between the rear end surface 48 of the metallic shell 40 and the wall surface of the axial hole 43. As described above, the axial hole 43 opens at the rear end surface 48 of the metallic shell 40 at the increased-diameter portion 45, and the opening thereof is chamfered. In the present embodiment, this chamfered portion is considered to be a portion of the wall of the axial hole 43, and the opening diameter (i.e., the diameter of the opening) of the rear end surface 48 is regarded as the diameter d4 of the ridge line between the rear end surface 48 and the wall surface of the axial hole 43.

Further, as in the case of the above-mentioned minimum inner diameter D1, for the tangential lines T3, T4, T5, and T6 shown in FIG. 4, which are parallel to the axis P (and thus perpendicular to the radial direction) and which are tangent to two cross sections of the O-ring 70 obtained by cutting the O-ring 70 with an imaginary plane passing the axis P, the distance between the tangential lines T3 and T6, which are located further from the axis P than the remaining tangential lines, is regarded as the maximum outer diameter D2 of the O-ring 70. When the O-ring 70 is fitted onto the center shaft 30 from the rear end portion 32 and is moved toward the interior of the axial hole 43 along the center shaft 30, the O-ring 70 does not come into contact with the rear end surface 48, and thus the O-ring 70 can be readily guided into the axial hole 43, if the maximum outer diameter D2 of the O-ring 70 is smaller than the diameter d4, which is the opening diameter of the rear end surface 48.

Figure 6:
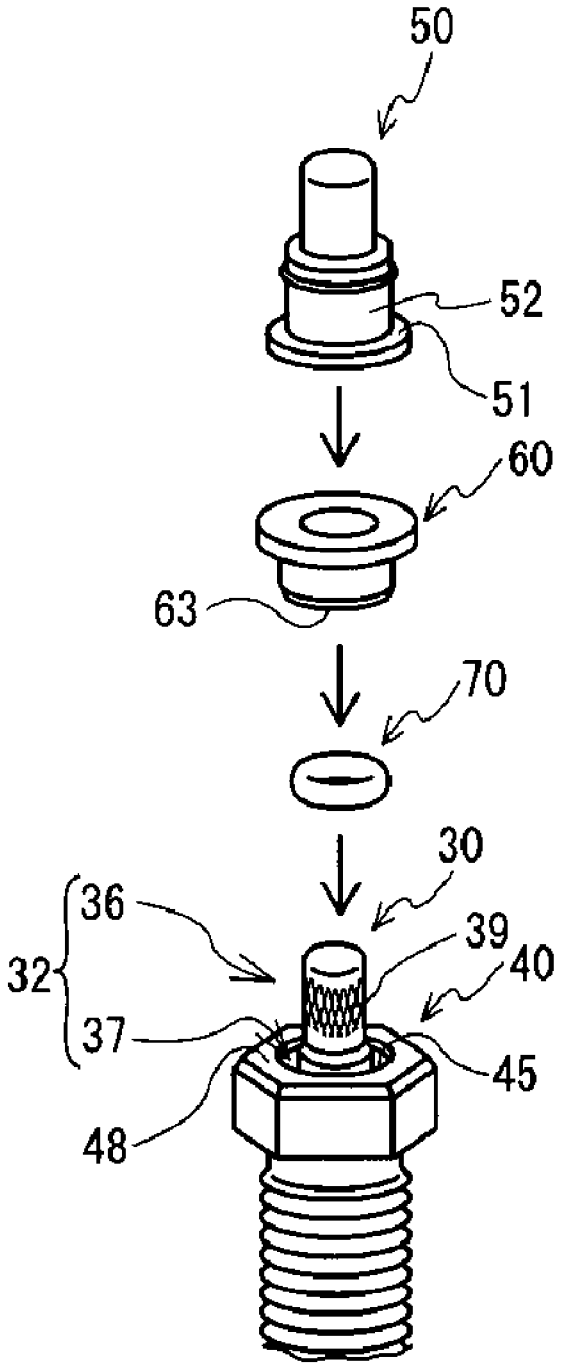
FIG. 6 is a schematic view showing a terminal assembly step in a process of manufacturing the glow plug of FIG. 1.

The O-ring 70, having a size and shape defined as described above, is disposed between the metallic shell 40 and the center shaft 30 in a terminal assembly step shown in FIG. 6. The latter is one step in a process for manufacturing the glow plug 100, whereby the glow plug 100 is completed. However, before further describing the terminal assembly step, the process of manufacturing the glow plug 100 will be generally described with reference to FIGS. 1, 2, and 6. FIG. 6 is a view schematically showing the terminal assembly step of the process of manufacturing the glow plug 100.

In the process of manufacturing the glow plug 100 shown in FIG. 1, an element green body (prototype) of the heat generation element 24 of the ceramic heater 20 is first formed through injection molding of a material including conductive ceramic powder, binder, etc. Meanwhile, a substrate green body (prototype) of the substrate 21 of the ceramic heater 20, which is composed of two halved green bodies, is formed through die-press molding from an insulating ceramic powder, such that the halved green bodies have, on their parting faces, a recess for accommodating the element green body. The substrate green body then undergoes press compression with the element green body accommodated and held in the recesses of the substrate green body. This is followed by a debindering process and a firing process such as hot pressing. Subsequently, the resultant product is shaped into the form of a rod having a semi-spherical end by means of grinding the outer circumference surface thereof, whereby the ceramic heater 20 is formed.

Next, the connection ring 75, which is made of a steel material such as stainless steel and is formed into a pipe-like shape, is press-fitted onto the ceramic heater 20 so as to establish electrical continuity between the connection ring 75 and the electrode output portion 26. Similarly, the tubular member 80, which is formed into a predetermined shape, is press-fitted onto the ceramic heater 20 so as to establish electrical continuity between the tubular member 80 and the electrode output portion 25.

Preferably, the connection ring 75 and the tubular member 80 are plated with Au, Cu, or the like so as to stabilize the electrical continuity.

Meanwhile, the center shaft 30 is formed by performing plastic working, cutting, etc. on a rod-shaped member, which is obtained by cutting an iron-based material (e.g., Fe—Cr—Mo steel) to a predetermined length. The outer circumference of the engagement portion 34 of the center shaft 30 is engaged with the inner circumference of the connection ring 75 fitted onto the ceramic heater 20, and laser welding is performed on the joint portion between these members, whereby the center shaft 30 and the ceramic heater 20 are integrally joined.

Next, the tubular metallic shell 40 having the tool engagement portion 46, etc. is formed from an iron-based material such as S45C, and a screw thread is formed at the male thread portion (mounting threaded portion) 42. The center shaft 30 integrated with the ceramic heater 20, etc., and is inserted into the axial hole 43 of the metallic shell 40 from the rear end 32 thereof. Subsequently, the joint portion between the metallic shell 40 and the tubular member 80 is laser-welded, whereby these members are integrally joined. It is noted that, in order to avoid rusting of the metallic shell 40 formed of an iron-based material, the metallic shell 40 may be plated in advance before being joined with the tubular member 80, or a rust prevention process such as plating or painting may be performed after the metallic shell 40 and the tubular member 80 are joined together.

Subsequently, the terminal assembly step shown in FIG. 6 is performed. The O-ring 70 is fitted onto the terminal connection portion 36 of the rear end portion 32 of the center shaft 30 projecting from the rear end surface 48 of the metallic shell 40. As described above, the minimum inner diameter D1 of the O-ring 70 is greater than the maximum outer diameter d1 of the terminal connection portion 36 of the center shaft 30. Therefore, the O-ring 70 can easily pass over the terminal connection portion 36, and reaches the seal portion 37. Further, since the maximum outer diameter D2 of the O-ring 70 is smaller than the diameter d4, which is the opening diameter of the axial hole 43 that opens at the rear end surface 48 of the metallic shell 40, the O-ring 70 is easily accommodated within the increased-diameter portion 45.

Because the outer diameter d2 of the seal portion 37 is greater than the minimum diameter D1 of the O-ring 70, the O-ring 70 is readily moved toward the front end side while sliding on the outer circumferential surface of the seal portion 37, and ultimately reaches the tapered surface 47 of the axial hole 43 of the metallic shell 40 (see FIG. 2).

The press member 60 is fitted onto the rear end portion 32 of the center shaft 30 at this stage, and the body portion 65 thereof is disposed between the wall surface of the increased-diameter portion 45 of the axial hole 43 of the metallic shell 40 and the seal portion 37 of the center shaft 30. Further, the metal terminal member 50 is fitted onto the terminal connection portion 36 of the rear end portion 32 of the center shaft 30, the terminal connection portion 36 including the knurled engagement portion 39, and the press member 60 is pressed toward the front end side by means of the flange portion 51 of the terminal metal piece 50. As a result, the O-ring 70 is pressed toward the front end by means of the end surface 63 of the press member 60. In this state, the O-ring 70 is forced into close contact with the tapered surface 47 of the axial hole 43 of the metallic shell 40 and the outer circumferential surface of the seal portion 37 of the center shaft 30, without substantial deformation, whereby robust sealing of the axial hole 43 is achieved. The outer circumference of the body portion 52 of the terminal metal member or piece 50 is crimped so as to secure the terminal metal piece 50 to the center shaft 30, whereby the glow plug 100 is completed.

Example 1

In order to confirm the effects attained by defining the size and shape of the O-ring 70 that is assembled into the glow plug 100 manufactured in the above-described manner, an evaluation test was performed as discussed below. In this evaluation test, three O-rings 70 were manufactured to have the shape described above for a preferred embodiment such that for the contour of a transverse cross section of the O-ring, the distance (the distance V shown in FIG. 4) between two spaced tangential lines parallel to the radial direction was 1.65 mm, the distance (the distance H shown in FIG. 4) between two spaced tangential lines perpendicular to the radial direction was 1.2 mm, and such that the minimum inner diameter D1 was 3.9 mm (and the maximum outer diameter D2 was 6.3 mm). Three glow plug samples each incorporating one of these O-rings, i.e., having these three O-rings assembled thereto, were manufactured (and are designated as Sample Group 2) in Table 1 below. Further, three O-rings 70 were manufactured such that the contour of a transverse cross section was of a full, circular shape having a diameter of 1.1 mm, and the minimum inner diameter D1 was 4.1 mm (with the maximum outer diameter D2 being 6.3 mm). Three glow plug samples having these three O-rings assembled thereto were manufactured as comparative examples (and are designated as Sample Group 1 in Table 1).

These various glow plug samples were manufactured such that a center shaft was formed wherein the maximum diameter of the terminal connection portion was 3.75 mm, and the diameter of the seal portion was 3.95 mm, and such that a metallic shell was formed wherein the diameter of the axial hole was 5.0 mm, the diameter of the increased-diameter portion was 6.3 mm, the diameter of the opening of the axial hole at the rear end surface was 6.7 mm, and the taper angle of the tapered surface extending from the increased-diameter portion (the angle between the axis O and the tapered surface in a cross section including the axis O) was 150.

The manufactured glow plug samples were subjected to an evaluation test for evaluating "airtightness," i.e., the degree to which the axial hole was fully sealed and thus airtight. Specifically, an impact force of 2500 G was applied to each sample 10,000 times, a hole communicating the axial hole was formed at the front end portion of the metallic shell of each sample, and air under pressure was fed to the axial hole via the formed hole adjusted sequentially between three levels, viz., 0.6 MPa, 1.5 MPa, and 4.0 MPa. At each air pressure, determination was made as to whether or not air leaked from the clearance between the rear end surface of the metallic shell and the press member via the O-ring. In the evaluation test, each sample which caused air leakage was represented in Table 1 below using the designation "x," and each sample which did not cause air leakage was represented by designation "O." Table 1 shows the results of this evaluation test.

TABLE 1

| Sample | Airtightness | | |
|---|---|---|---|
| Group | 0.6 MPa | 1.5 MPa | 4.0 MPa |
| 1 | ○ | x | x |
| | x | x | x |
| | x | x | x |
| 2 | ○ | ○ | ○ |
| | ○ | ○ | ○ |
| | ○ | ○ | ○ |

As shown in Table 1, in the case of the glow plugs in Sample Group 1 which contain the O-ring formed such that the contour of a transverse cross section is of a fully completely circular shape, one of the three samples was able to maintain airtightness when the air pressure was 0.6 MPa, but all the samples suffered air leakage when the air pressure was set to 1.5 MPa and when the air pressure was set to 4.0 MPa.

In contrast, in the case of the glow plugs in Sample Group 2 which contain the O-ring formed such that the contour of a transverse cross section is of an elliptical shape, the samples did not experience any air leakage at any air pressure. The results of this evaluation test confirm that when the O-ring is formed such that the contour of a transverse cross section is of an elliptical shape, the area of contact of the O-ring with the outer circumferential surface of the seal portion of the center shaft and the tapered surface of the axial hole of the metallic shell can be increased so as to increase the degree of contact with these two surfaces, so that sealing or airtightness of the axial hole can be reliably maintained.

Figure 7:
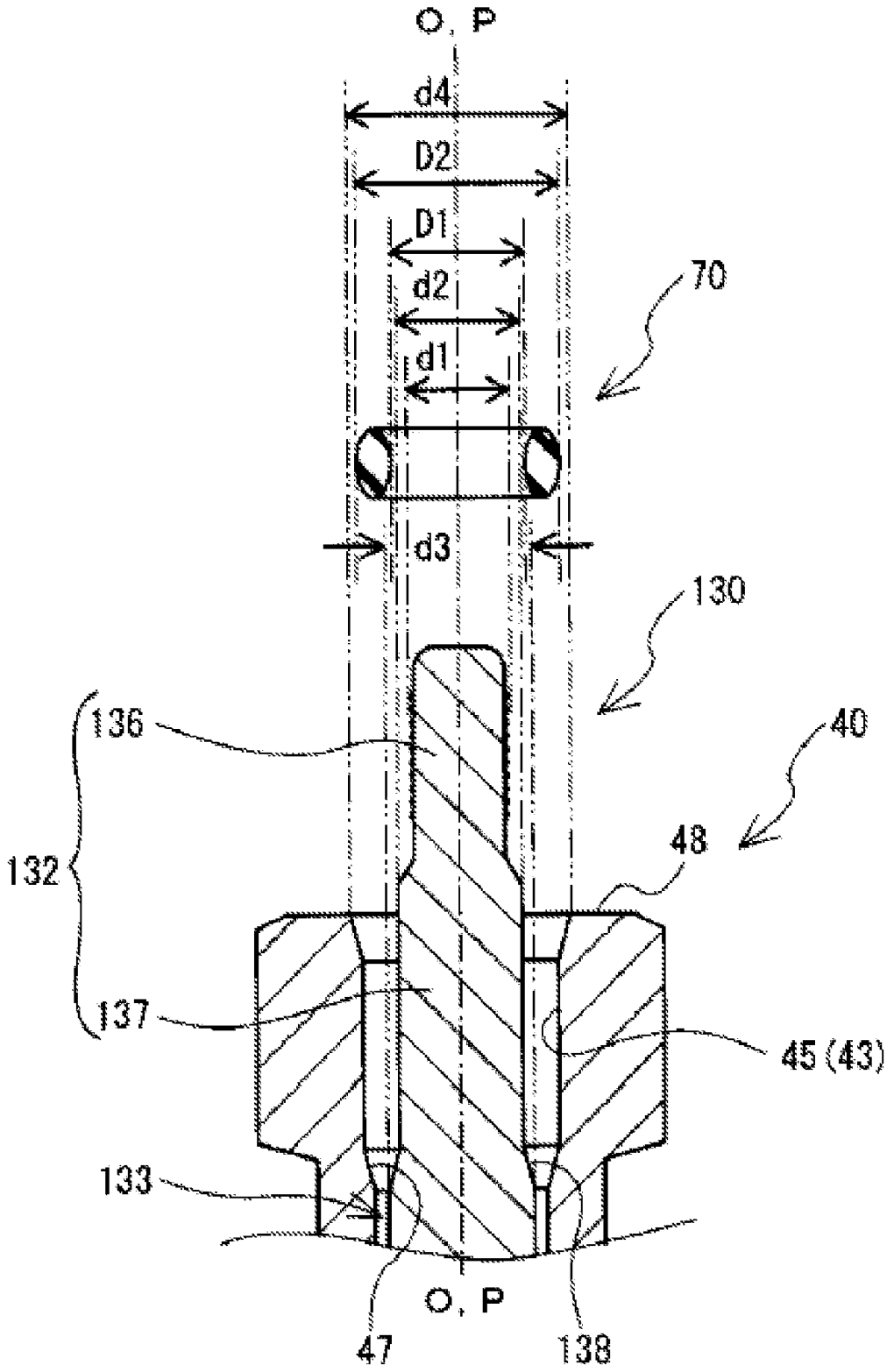
FIG. 7 is a cross sectional view showing a condition before the O-ring is disposed between a center shaft and a metallic shell according to a further embodiment of the invention.

The embodiment of the present invention described above can be modified in various ways. For example, referring to FIG. 7, a center shaft 130 such as shown in FIG. 7 may be employed. A rear end portion 132 of the center shaft 130 includes a rear body portion 137 which is located ahead or frontwardly of a terminal connection portion 136 and within the increased-diameter portion 45 of the axial hole 43 of the metallic shell 40 and which has a diameter d2 different from the diameter d3 of an intermediate body portion 133 of the center shaft 130, and a tapered surface 138 is provided between the intermediate body portion 133 and the rear body portion 137. In this embodiment, the O-ring 70 is brought into contact with this tapered surface 138, and the O-ring 70 is pressed forwardly or frontwardly by means of the press member so as to produce drag between the O-ring 70 and the tapered surface 138, to thereby increase the degree of the contact therebetween.

In this case, the airtightness of the axial hole 43 can be maintained more reliably as in the case of the above-described embodiment. It is noted that, in order to make the drag produced between the tapered surface 138 of the center shaft 130 and the O-ring 70 equal to the drag produced between the tapered surface 47 of the axial hole 43 and the O-ring 70, the end surface 63 of the press member 60 of the above-described embodiment is preferably formed by a flat surface extending perpendicularly to the axis O.

In the modification under consideration, the direction of the drag produced as a result of contact between the O-ring 70 and the tapered surface 138 of the center shaft 30 intersects the direction of the axis O. Therefore, in the case where the minimum diameter D1 of the O-ring 70 is made smaller than the diameter d2 of the rear body portion 137 of the center shaft 130, when the O-ring 70 is fitted onto the center shaft 130 from the rear end portion 132, the O-ring 70 passes over the terminal connection portion 136, whose maximum diameter d1 is smaller than the diameter d2 of the rear body portion 137, then passes over the rear body portion 137, and readily reaches the tapered surface 138.

In the case where the center shaft 130 is configured such that the diameter d3 of the intermediate body portion 133 located forwardly of the rear body portion 137 is greater than the minimum inner diameter D1 of the O-ring 70, when the O-ring 70 is fitted onto the center shaft 130 from the rear end portion 132, the O-ring 70 can be reliably brought into contact with the tapered surface 138. In other words, when the O-ring 70 is pressed from the rear end side by means of the press member 60 (see FIG. 2), drag can be reliably produced between the O-ring 70 and the tapered surface 138, and these elements can be brought into close contact.

Moreover, in the case where the maximum outer diameter D2 of the O-ring 70 is made smaller than the diameter d4, which the opening diameter of the rear end surface 48 of the metallic shell 40, the O-ring 70 can be easily guided into the axial hole 43 without engaging the rear end surface 48, as in the above-described embodiment.

Figure 8:
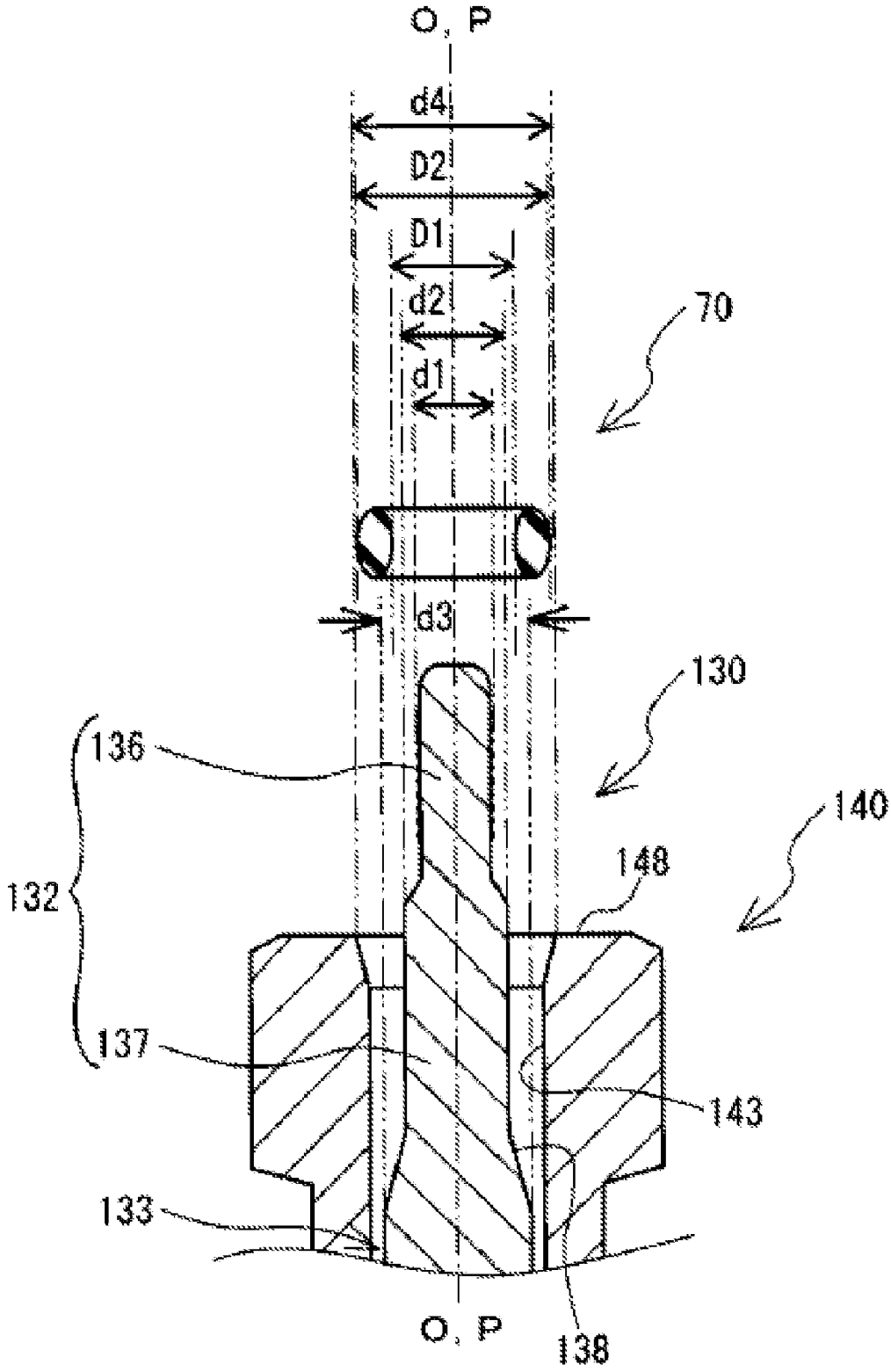
FIG. 8 is a sectional view showing a condition before the O-ring is disposed between a center shaft and a metallic shell, according to another embodiment of the invention.

Referring to FIG. 8, when a center shaft 130 in which a taper 138 is provided as shown in FIG. 8 is used, a metallic shell 140 configured such that a tapered surface or an increased-diameter portion is not formed in an axial hole 143 thereof, can be used. Thus, the airtightness of the axial hole 143 can be reliably maintained as in the above-described embodiment. In this case as well, the minimum inner diameter D1 of the O-ring 70 is preferably made greater than the diameter d2 of the rear body portion 137 and smaller than the diameter d3 of the intermediate body portion 133. Further, as in the above-described case, the maximum outer diameter D2 of the O-ring 70 is preferably made smaller than the diameter d4, which the opening diameter of the rear end surface 148 of the metallic shell 140.

In the above-described embodiment, the transverse cross section of the O-ring 70 is of an elliptical shape. It is to be understood that, in general, the transverse cross section may have a different overall shape, and may have any shape so long as the contour S of the transverse cross section is of a shape whose length in the direction of the axis P is greater than that in the direction perpendicular to the direction of the axis P, as described above in relation to FIG. 4.

Figure 9:
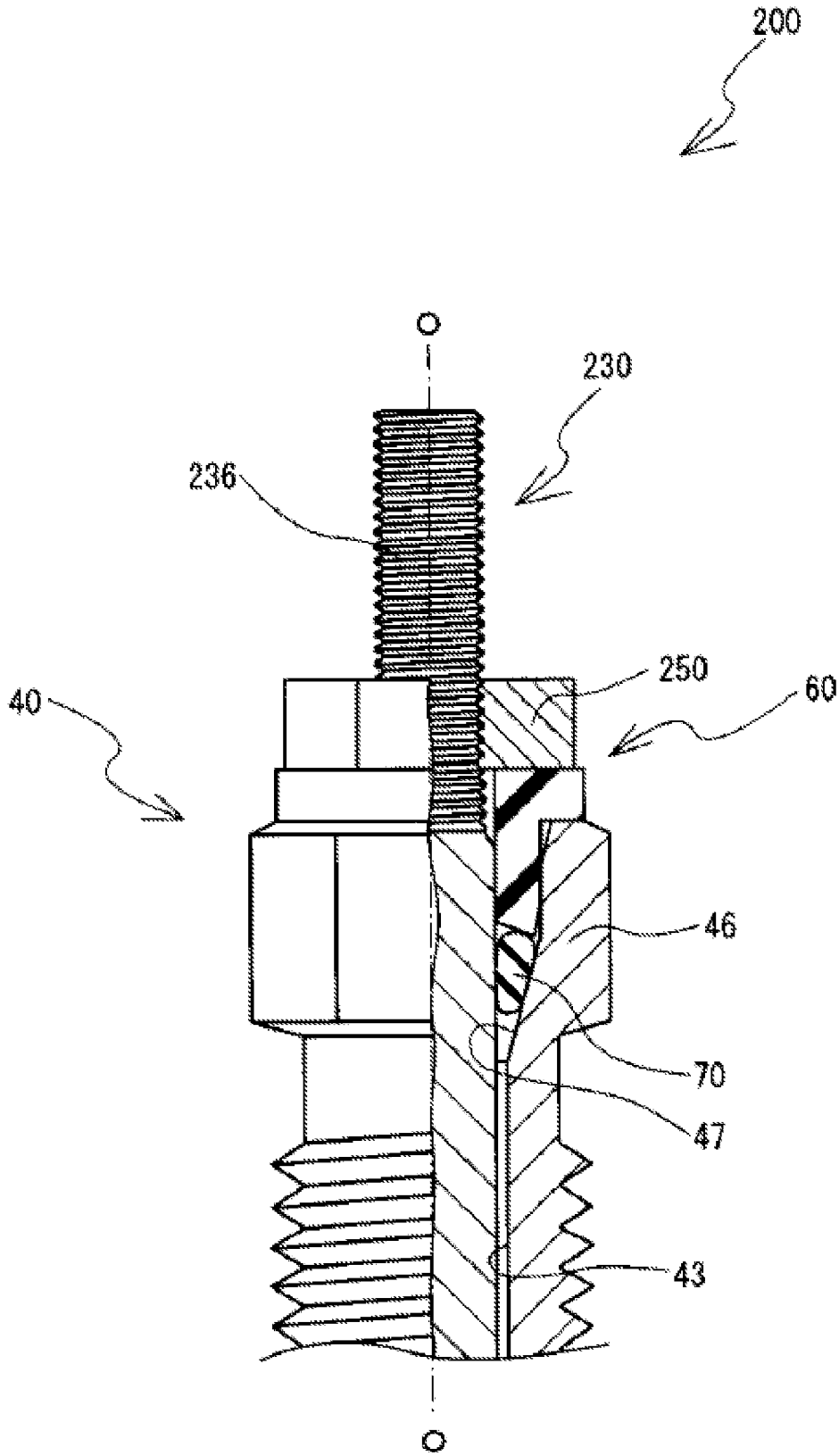
FIG. 9 is a cross sectional view showing a rear end portion, and its vicinity, of a glow plug according to still another embodiment of the invention.

In the above-described embodiment, the engagement portion 39 formed at the terminal connection portion 36 of the center shaft 30 is knurled. However, the engagement portion 39 may be in the form of bellows or projections, and is preferably configured such that the metal terminal piece or member 50 can be engaged with the terminal connection portion 36, and these members can be firmly fixed together by means of crimping. Considering this point further and referring to FIG. 9, it will, of course, be understood that as in the glow plug 200 shown in FIG. 9, a nut may be used in place of the metal terminal member or piece. Specifically, in FIG. 9, a male thread is formed on the outer circumferential surface of a terminal connection portion 236 of a center shaft 230, and a nut 250 is screwed onto the male thread so as to press the press member 60 frontward along the axis. A connection terminal (not shown) of an external circuit is screwed to the male thread of the terminal connection portion 236 exposed rearwardly from the nut 250 so as to establish an electrical connection. It is noted that the connection between the center shaft 230 and the connection terminal of the external circuit via the terminal connection portion 236 shown in the present modification is one example of the case where the center shaft and the connection terminal are connected "directly" in accordance with one embodiment of the present invention.

In contrast, the implementation where the metal terminal piece 50 is provided at the rear end of the center shaft 30 and the connection terminal (not shown) of the external circuit is connected to the metal terminal piece 50 is one example of the case where the center shaft and the connection terminal are connected "indirectly" in accordance with an alternative embodiment of the present invention.

The connection terminals of some external circuits have the form of a washer. Such a connection terminal can be connected to the center shaft directly or indirectly. For example, when the connection terminal is in the form of a washer having a large inner diameter, the connection terminal is engaged with the center shaft 230 as in the above-described modification, and a second nut (not shown) is screwed onto the center shaft 230 so as to hold the connection terminal between the nut 250 and the second nut. In this way, the connection terminal is connected "indirectly" to the center shaft 230 via the nut. When the connection terminal has the form of a washer having a small inner diameter, the connection terminal is connected "directly" to the center shaft 230 as a result of the connection terminal being held by the nut in a condition in which the inner circumference of the connection terminal is in contact with the male thread of the center shaft 230 and electrical continuity is established therebetween.

The glow plug of the above-described embodiment includes the ceramic heater 20 in which the heat generation element 24, formed of a conductive ceramic, is embedded in the substrate 21 formed of an insulating ceramic. However, the heater is not limited to this implementation, and the glow plug may include a sheath heater configured such that a coil-shaped heat generation resistor and a control resistor are disposed within a metallic sheath tube whose distal end portion is closed to form a semispherical shape.

It will be appreciated that the present invention can be applied not only to glow plugs having only a heat generation function, but also to glow plugs including a temperature sensor, a pressure sensor, or the like.

Although the invention has been described above in relation to preferred embodiments thereof, it will be understood by those skilled in the art that variations and modifications can be effected in these preferred embodiments without departing from the scope and spirit of the invention.

What is claimed is:

1. A glow plug comprising:

a tubular metallic shell including an axial hole extending through the metallic shell along an axis;

a rod-shaped center shaft extending along the axis and disposed in the axial hole of the metallic shell with a clearance between the center shaft and a wall surface of the axial hole, one end portion of the center shaft projecting from a rear end surface of the metallic shell;

an O-ring disposed at a rear end of the axial hole between the wall surface of the axial hole and the center shaft, the O-ring being in close contact with the wall surface of the axial hole and an outer circumferential surface of the center shaft; and an annular press member including an insertion hole into which the center shaft is inserted, the press member being at least partially disposed between the wall surface of the axial hole and the center shaft and including an end surface for pressing against the O-ring from the rear thereof;

at least one of a portion of the wall surface of the axial hole with which the O-ring is close contact and a portion of the outer circumferential surface of the center shaft with which the O-ring is close contact comprising a tapered surface that increases the clearance between the wall surface of the axial hole and the center shaft toward the rear end side along the axis; and the O-ring being of an annular shape extending circumferentially around said axis, and a radial direction of the O-ring being defined as extending radially from said axis, said O-ring having a transverse cross section of a contour which satisfies a relation $V>H$ wherein V represents a distance defined between two spaced tangential lines which are parallel to the radial direction of the O-ring and are tangent to said contour and H represents a distance between two spaced tangential lines which are perpendicular to said radial direction and are tangent to said contour.

2. The glow plug as claimed in claim 1, wherein the O-ring satisfies a relation $1.2<=V/H<=2.0$ prior to assembly of the O-ring to the glow plug.

3. The glow plug as claimed in claim 1, wherein the center shaft includes a terminal connection portion which is provided at a rear end thereof and to which a connection terminal of an external circuit is connected directly or indirectly; and a relation D1>d1 is satisfied prior to assembly of the O-ring to the glow plug, wherein D1 represents the minimum inner diameter of the O-ring, and d1 represents the maximum diameter of the terminal connection portion of the center shaft.

4. The glow plug as claimed in claim 3, wherein a relation d1<d2 is also satisfied, wherein d2 represents the diameter of the center shaft at a portion located forwardly of the terminal connection portion in the direction of said axis, and a relation D1<d2 is also satisfied.

5. The glow plug as claimed in claim 1, wherein the tapered surface is formed at a portion of the outer circumferential surface of the center shaft with which portion the O-ring comes into close contact; and a relation d2<D1<d3 is satisfied prior to assembly of the O-ring to the glow plug, wherein D1 represents the minimum inner diameter of the O-ring, d2 represents the diameter of the center shaft at a portion between the terminal connection portion and the tapered surface, and d3 represents the diameter of the center shaft at a portion located forwardly of the tapered surface in the direction of said axis.

6. The glow plug as claimed in claim 1, wherein a relation D2<d4 is satisfied prior to assembly of the O-ring to the glow plug, wherein D2 represents the maximum outer diameter of the O-ring, and d4 represents a diameter of a ridge line formed between the rear end surface of the metallic shell and the wall surface of the axial hole.

7. The glow plug as claimed in claim 1, wherein the metallic shell further comprises:

a threaded mounting portion for mounting the shell in a threaded hole of an internal combustion engine by screwing the mounting portion into the threaded hole; and a tool engagement portion for engaging a tool used when the threaded mounting portion is screwed into the threaded hole;

the metallic housing having a width across a corner of no more than 8.8 mm or less at the tool engagement portion, and the metallic shell having a nominal outer diameter of no more than 8 mm at the threaded mounting portion.

8. A glow plug comprising:

a tubular metallic shell including an axial hole extending through the metallic shell along an axis;

a rod-shaped center shaft extending along the axis and disposed in the axial hole of the metallic shell with a clearance between the center shaft and a wall surface of the axial hole, one end portion of the center shaft projecting from a rear end surface of the metallic shell;

an O-ring disposed at a rear end of the axial hole between the wall surface of the axial hole and the center shaft, the O-ring being in close contact with the wall surface of the axial hole and an outer circumferential surface of the center shaft; and an annular press member including an insertion hole into which the center shaft is inserted, the press member being at least partially disposed between the wall surface of the axial hole and the center shaft and including an end surface for pressing against the O-ring from the rear thereof;

at least one of a portion of the wall surface of the axial hole with which the O-ring is close contact and a portion of the outer circumferential surface of the center shaft with which the O-ring is close contact comprises a tapered surface that increases the clearance between the wall surface of the axial hole and the center shaft toward the rear end along the axis; and the O-ring being of an annular shape circumferentially surrounding said axis and being configured such at least one transverse cross section of the O-ring is of a contour wherein a first dimension thereof parallel to said axis is greater than a second dimension thereof perpendicular to said first dimension.

9. The glow plug as claimed in claim 8, wherein the O-ring is of uniform transverse cross section throughout.

10. The glow plug as claimed in claim 8, wherein the O-ring satisfies a relation 1.2<=V/H<=2.0 prior to assembly of the O-ring to the glow plug, wherein V represents the first dimension of the O-ring parallel to said axis, and H represents said second dimension of the O-ring perpendicular to said first dimension.

11. The glow plug as claimed in claim 8, wherein the center shaft includes a terminal connection portion which is provided at a rear end thereof and to which a connection terminal of an external circuit is connected directly or indirectly; and a relation D1>d1 is satisfied prior to assembly of the O-ring to the glow plug, wherein D1 represents the minimum inner diameter of the O-ring, and d1 represents the maximum diameter of the terminal connection portion of the center shaft.

12. The glow plug as claimed in claim 11, wherein a relation d1<d2 is also satisfied, wherein d2 represents the diameter of the center shaft at a portion located forwardly of the terminal connection portion in the direction of said axis, and a relation D1<d2 is also satisfied.

13. The glow plug as claimed in claim 8, wherein the tapered surface is formed at a portion of the outer circumferential surface of the center shaft with which portion the O-ring comes into close contact; and a relation d2<D1<d3 is satisfied prior to assembly of the O-ring to the glow plug, wherein D1 represents the minimum inner diameter of the O-ring, d2 represents the diameter of the center shaft at a portion between the terminal connection portion and the tapered surface, and d3 represents the diameter of the center shaft at a portion located forwardly of the tapered surface in the direction of said axis.

14. The glow plug as claimed in claim 8, wherein a relation D2<d4 is satisfied prior to assembly of the O-ring to the glow plug, wherein D2 represents the maximum outer diameter of the O-ring, and d4 represents a diameter of a ridge line formed between the rear end surface of the metallic shell and the wall surface of the axial hole.

15. The glow plug as claimed in claim 8, wherein the metallic shell further comprises:

a threaded mounting portion for mounting the shell in a threaded hole of an internal combustion engine by screwing the mounting portion into the threaded hole; and a tool engagement portion for engaging a tool used when the threaded mounting portion is screwed into the threaded hole;

the metallic housing having a width across a corner of no more than 8.8 mm or less at the tool engagement portion, and the metallic shell having a nominal outer diameter of no more than 8 mm at the threaded mounting portion.

* * * * *